US006915543B2

(12) United States Patent
McEntyre et al.

(10) Patent No.: US 6,915,543 B2
(45) Date of Patent: Jul. 12, 2005

(54) ULTIMATE BRUSH

(76) Inventors: Sally Marie McEntyre, Windy Knoll Estates, 109 Bradley Dr., Baldwin, GA (US) 30511; Richard C. McEntyre, Windy Knoll Estates, 109 Bradley Dr., Baldwin, GA (US) 30511

( * ) Notice: Subject to any disclaimer, the term of this patent is extended or adjusted under 35 U.S.C. 154(b) by 403 days.

(21) Appl. No.: 10/189,407

(22) Filed: Aug. 30, 2002

(65) Prior Publication Data

US 2003/0070244 A1 Apr. 17, 2003

Related U.S. Application Data

(60) Provisional application No. 60/329,179, filed on Oct. 15, 2001.

(51) Int. Cl.[7] ..... A46B 3/18; A46B 5/00; A46B 9/02

(52) U.S. Cl. ..... 15/160; 15/168; 15/186; 15/206; 132/120; D4/128; D4/131

(58) Field of Search ..... 15/159.1, 160, 15/164, 168, 186, 187, 206; 132/120; D4/127, 128, 130–134, 136

(56) References Cited

U.S. PATENT DOCUMENTS 582,190 A * 5/1897 Eastman ..... 15/27
1,967,597 A * 7/1934 Rudolf ..... 15/206
2,228,067 A * 1/1941 Von Den Driesch ..... 15/164
4,030,158 A * 6/1977 Blair et al. ..... 15/207.2
4,167,192 A * 9/1979 Arnold ..... 132/212
D366,153 S * 1/1996 Stoller ..... D4/128
D467,737 S * 12/2002 Park ..... D4/128

FOREIGN PATENT DOCUMENTS

| | | |
|---|---|---|
| DE | 19924598 | * 11/2000 |
| EP | 233304 | * 8/1987 |
| JP | 7-236518 | * 9/1995 |
| JP | 11-103934 | * 4/1999 |
| WO | 89/04619 | * 6/1989 |

* cited by examiner

*Primary Examiner*—Mark Spisich

(57) ABSTRACT

A cone hair care brush is provided which enables multiple curls of varying diameters within each lock of hair. Also, the cone hairbrush allows for a root lifter to achieve more body to the overall look of the hair by applying the smallest end of the cone brushhead invention to the scalp while lifting and blow drying the hair simultaneously. The cone brushhead may include ventilation holes that would allow the hair to blow dry much faster.

2 Claims, 8 Drawing Sheets

ULTIMATE BRUSH

This application claims priority of provisional application No. 60/329,179, filed Oct. 15, 2001.

The Ultimate Brush is a convenient, economical and new development in the hair care industry. Very stylish and innovative while achieving multiple curl sizes and a root lifter with the use of only one brush.

FIELD OF THE INVENTION

The present invention concerns a method and device for acquiring a multiplicity of hair curl diameters, pinpoint root lifting and hairstyles, in particular a cone shaped brush head that allows for a range of small to large curls.

DESCRIPTION OF PRIOR ART

It is known that persons with straight hair wish to temporarily curl and style their hair through techniques such as blow-drying damp hair with hot air and a brush. It is common to gently wind a plurality of strands of hair on a cylindrical brush head in an effort to curl the hair.

However, the curl developed by a typical cylindrical brush head is limited to the constraints of a constant-diameter. Also, cylindrical brush heads are cumbersome and hardly achieve a pinpoint root lifter for the hair. Small cylindrical heads produce small helixes and large cylindrical helixes produce large helixes.

It is therefore an object of the present invention to surpass the disadvantages associated with conventional hairbrushes, and to provide a plurality of curl diameters and pinpoint root lifter for styling hair into shapes that cannot be achieved using conventional brushes.

SUMMARY OF THE INVENTION

The present invention aims an improved method and device for acquiring a multiplicity of diameters and pinpoint root lifter to achieve more body to the hair at the root which is new and which moreover offers several advantages.

To this end, the invention aims a method for achieving a plurality of curl diameters, whereby curls are formed once a damp section of hair is wound gently around the cone brush head and onto a pre-selected diameter, which is provided with the cone shaped brush head accompanied by a hot-air blow dryer for rapid results in setting the curl.

As the small end of the brush head makes contact with the root, gently pulling the towel dried hair through the bristles, this offers the advantage that one does need to achieve a select and isolated root lifter to achieve more body for a specified lock of hair accompanied by a hot-air blow dryer for rapid results.

Also according to the invention, the time-consuming intermediate treatment of changing from one cylindrical brush head to another, which is necessary in known embodiments in order to allow the hair to be quickly set into the various-diameter helix, is excluded.

Another ensuing advantage consists in that the cone shape brush head obtains a variety of diameters along its length, which provides convenient, quick and easy curl sizes.

Additional objects and advantages of the various aspects of the present invention will become apparent from the following description of the preferred embodiment in conjunction with the accompanying drawings.

DETAILED DESCRIPTION OF THE PREFERRED EMBODIMENT

Figure 1:
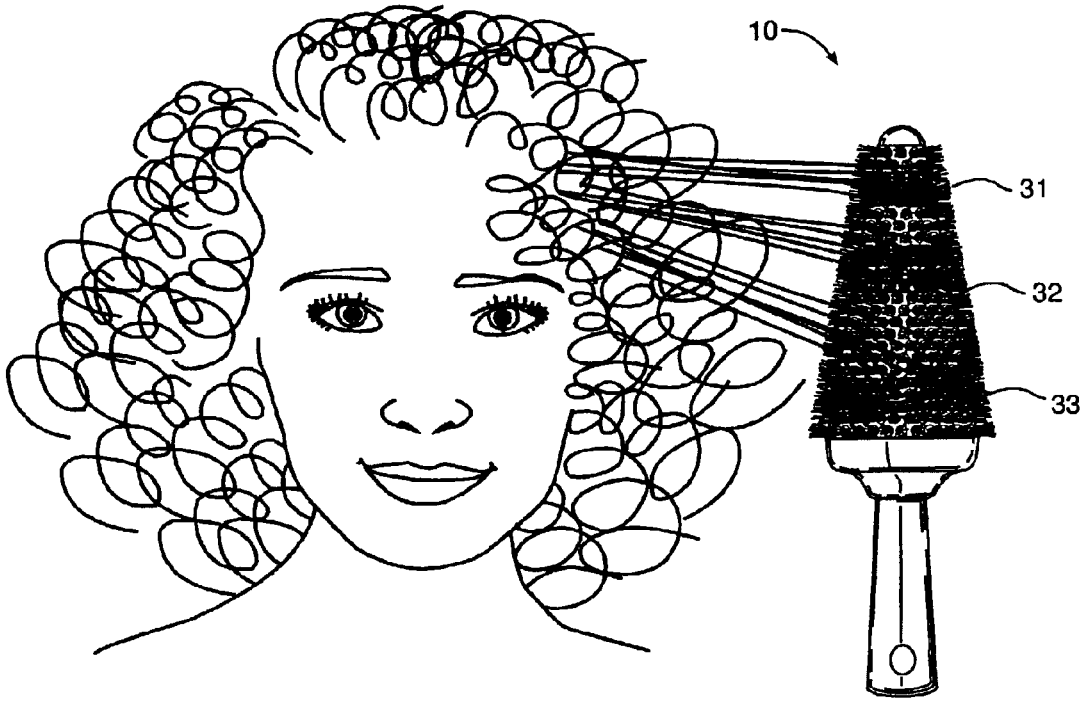
FIG. 1 shows a front view of a person using the cone brush head 10 of the Parent Application.

With general reference to the drawings a cone brush head for styling hair is identified at reference numeral 10 and includes a rigid body 12 ideally molded from plastic and metal material.

Figure 2A:
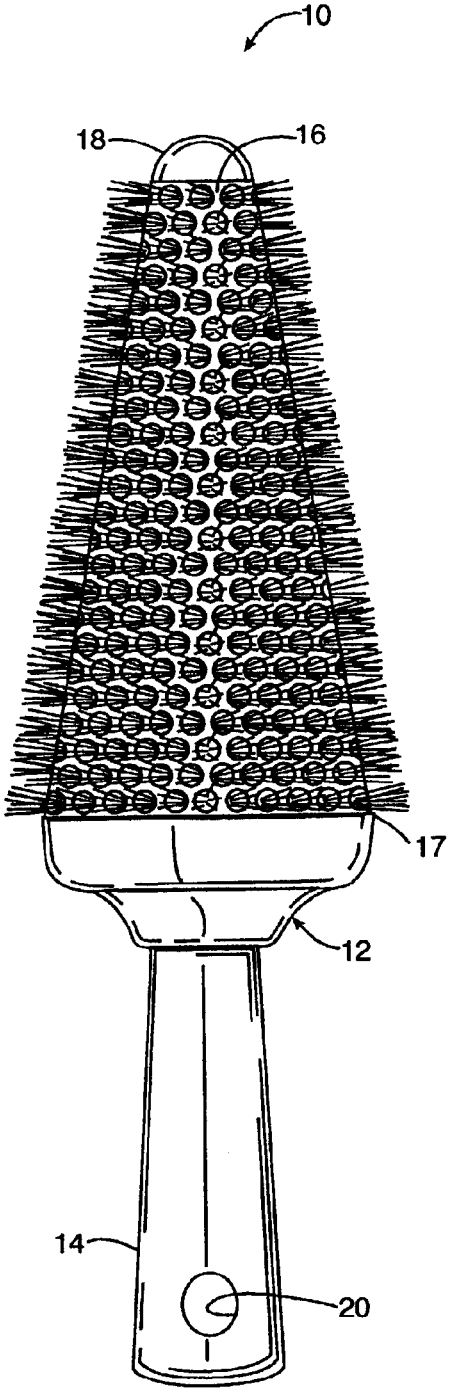
FIG. 2A illustrate an embodiment of a hot-air brush with an improved cone brush head 10 of the present invention.
Figure 2B:
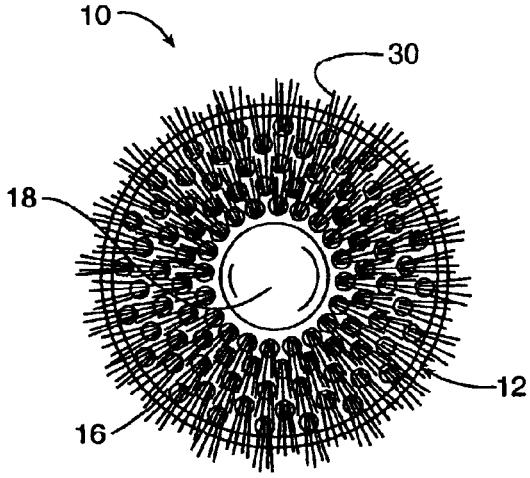
FIG. 2B illustrate a top end view embodiment of the improved cone brush head 10 of the present invention.
Figure 2C:
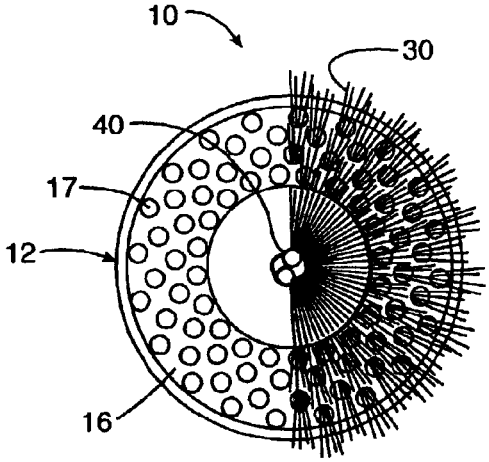
FIG. 2C illustrate an exploded top end view embodiment of the cone brush head 10 of the present invention.
Figure 3A:
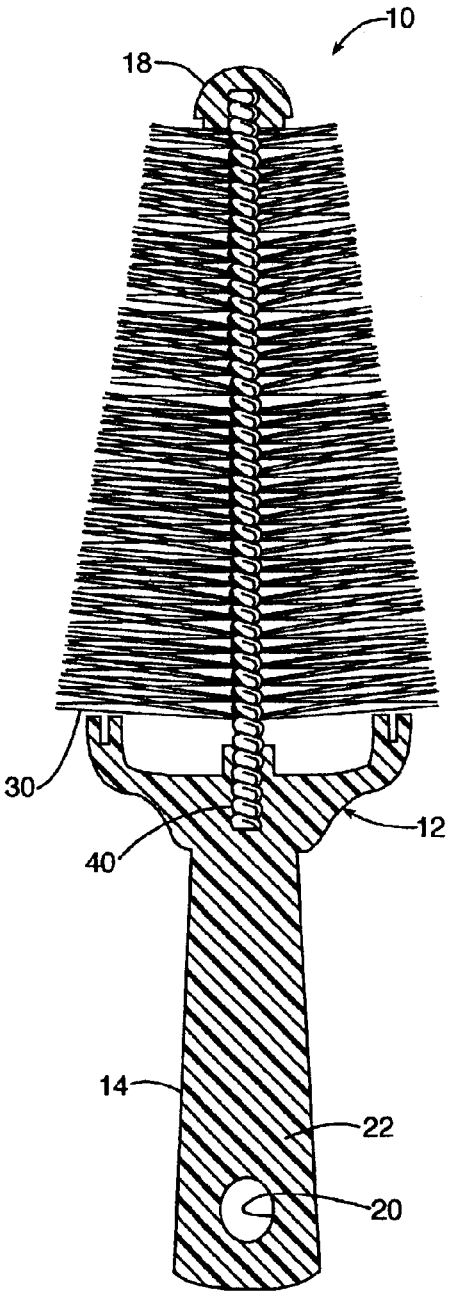
FIG. 3A illustrate an exploded side view embodiment excluding said metal material of the cone brush head 10 of the present invention.
Figure 3B:
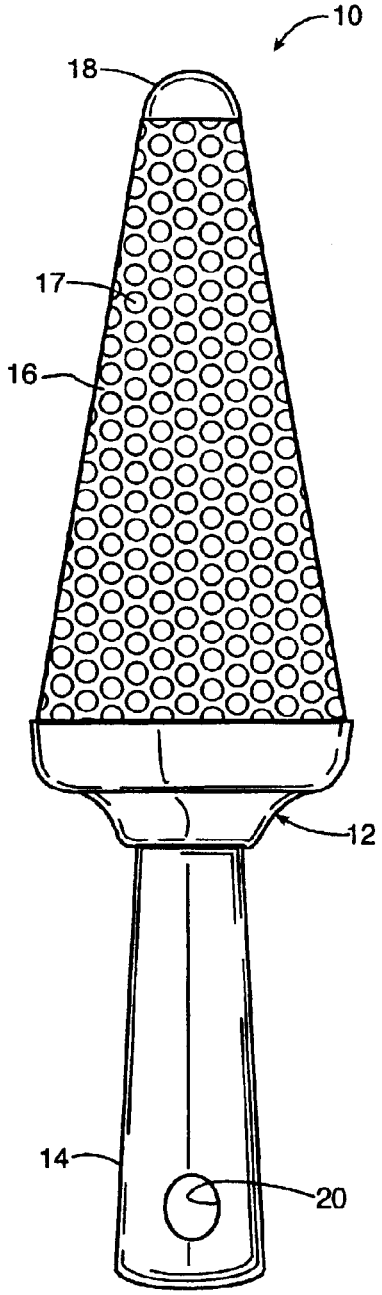
FIG. 3B illustrate another embodiment of the cone brush head 10 excluding said bristles of the present invention.
Figure 4:
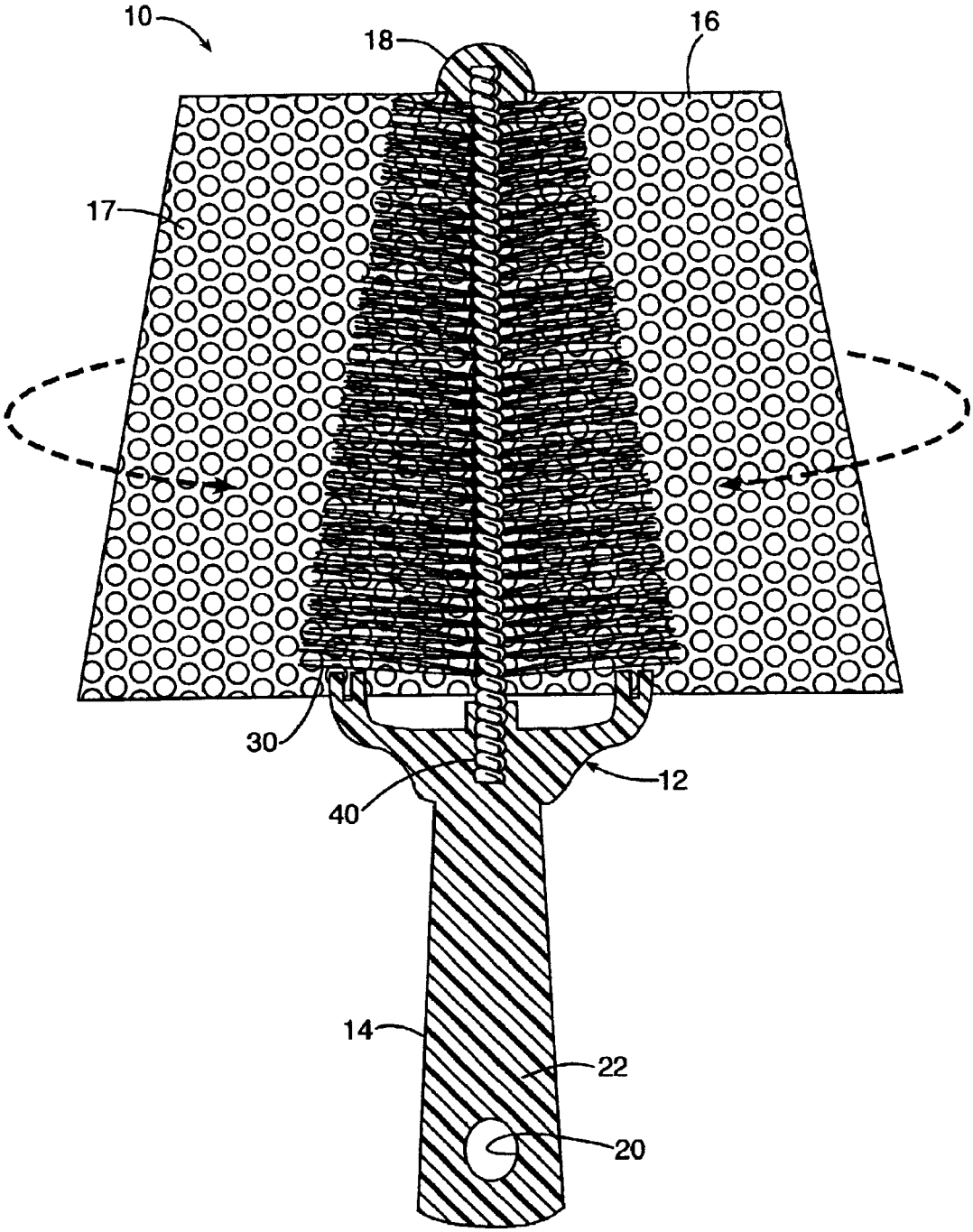
FIG. 4 illustrate still another exploded side view embodiment of the cone brush head 10 of the present invention.

FIGS. 1–4 illustrate one embodiment of the cone brush head 10 of the present invention. With initial reference to FIGS. 1 is a front view of a person with a view of the cone brush head (as viewed by the viewer). Brush 10 of the present invention is illustrated to generally include a main body 12 having a handle portion 14 and a head portion 16. FIG. 2A illustrate an embodiment of the cone brush head 10 of the present invention. FIG. 2B illustrates a top end view at the vertex of the cone brush head 10. FIG. 2C illustrates an exploded view of the top end of the cone brush head 10 with and without a portion of the bristles 30 to better define the details of the invention 10. FIG. 3A illustrates an exploded side view of the present invention 10 showing only the inside portion. FIG. 3B illustrates the metal hollow cavity 16 excluding the bristles 30. FIG. 4 illustrates an additional exploded side view of the brush head embodiment 10 that includes the metal material 16 in a flat form.

The main body 12 is ideally made of plastic and metal material. The handle portion 14 is generally cylindrical in shape. A distal end 22 of the handle portion 14 includes an aperture 20 so that the brush 10 can be hung from a peg.

The head portion 16 of the brush 10 is specifically cone in shape and made of thin metal material with a cone shaped hollow cavity 16 along its length and has defined thereon a number of holes 17. These holes include circular holes 17 that allow the air from the hot-air brush to pass through the cone brush head 10, thereby aiding in the drying and shaping of the hair.

With particular reference to FIG. 2C, FIG. 3A and FIG. 4, the bristled element 30 of the brush 10 of the present invention is constructed in a conventional manner to include a pair of metal wires 40. The wires 40 are twisted one to the other in an elongated fashion and capture a plurality of bristles 30 protruding through the round air vents 17 of the cone brush head 10 portion. A retainer cap 18, preferably made of plastic material, is located at the vertex top end view of the cone brush head 10.

Figure 5A:
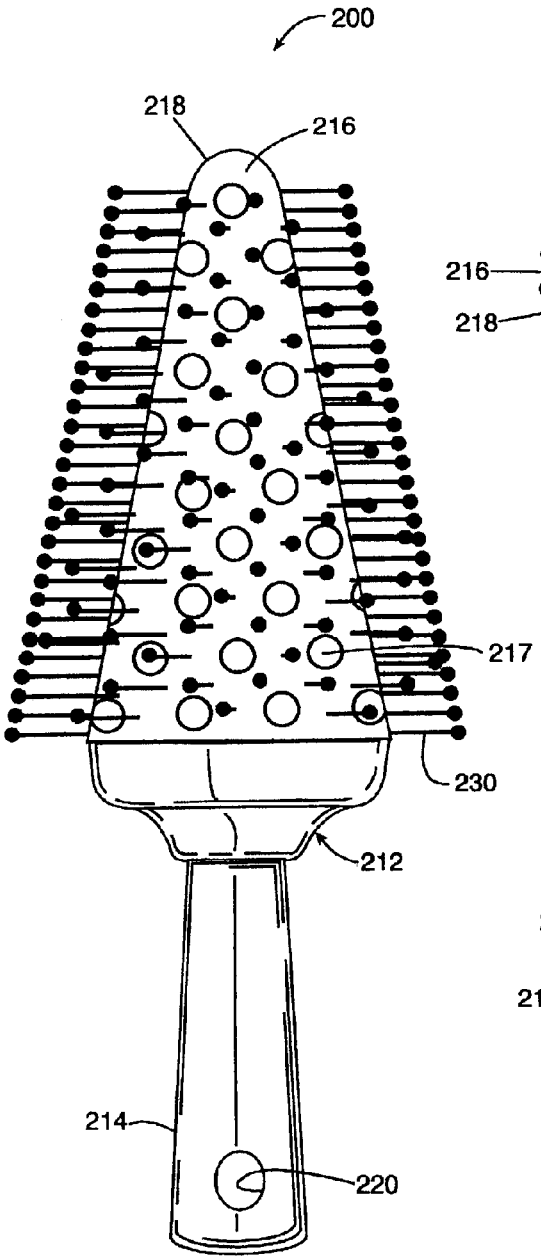
FIGS. 5A–5C and 6 illustrate an alternate embodiment of the cone brush head 200 of the present invention.
Figure 5B:
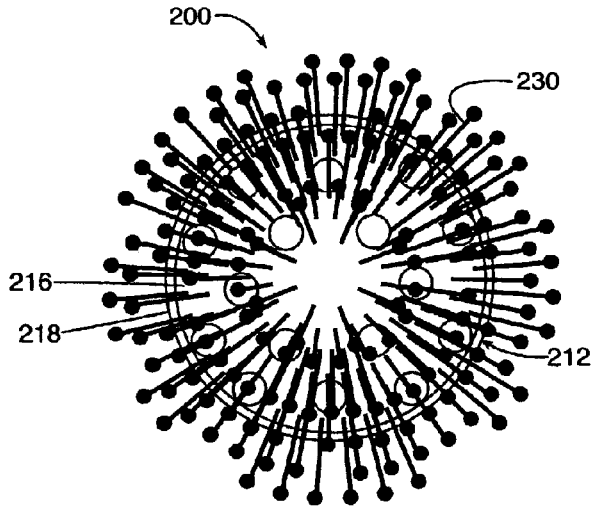
Figure 5C:
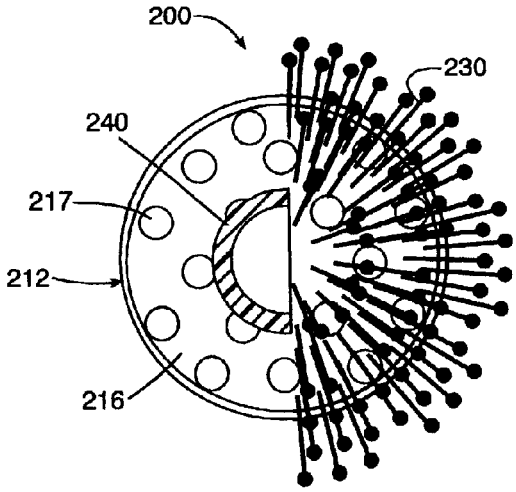
Figure 6:
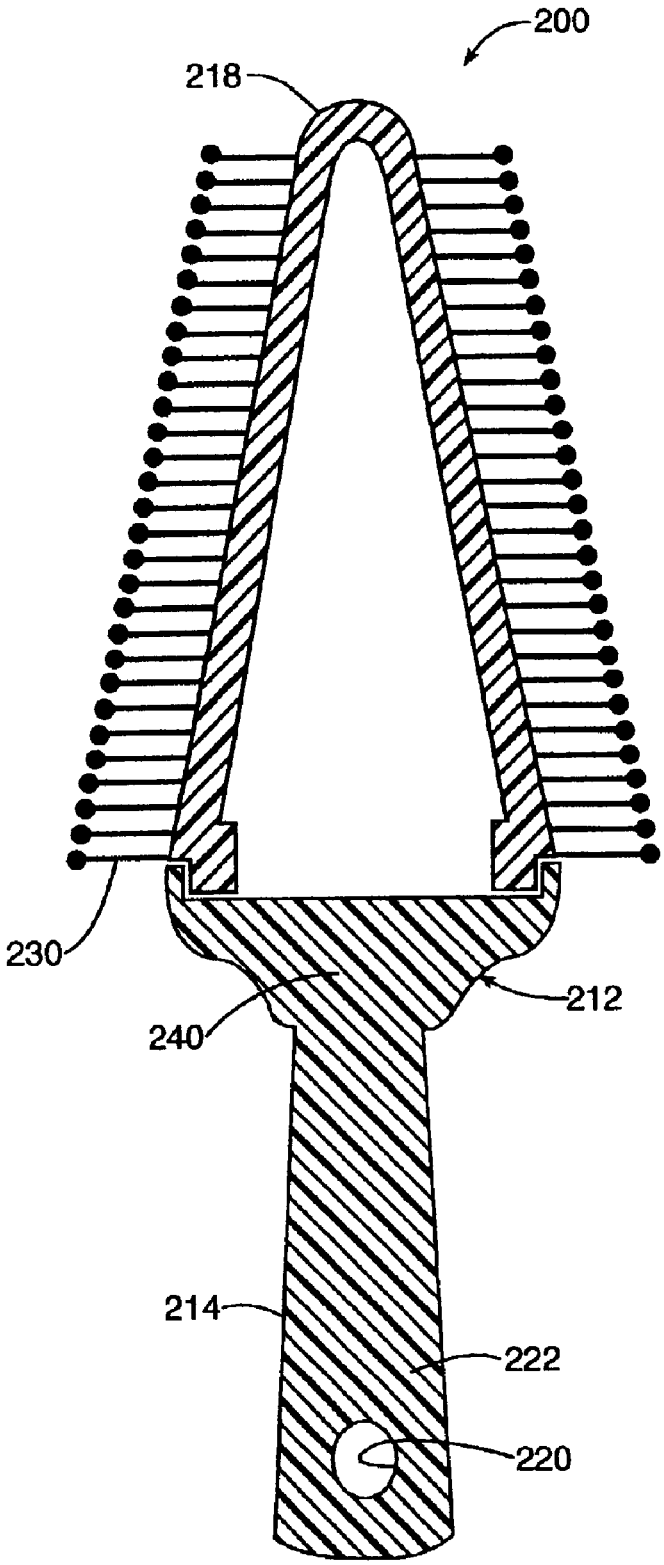

FIGS. 5A–6 illustrate an alternate embodiment of the cone brush head 200 of the present invention. FIG. 5A illustrates a frontal view of hair brush 200. FIG. 5B illustrates a top view of hair brush 200. FIG. 5C illustrates an additional top view with a small exploded view of hair brush 200. FIG. 6 illustrates an exploded frontal view of hair brush 200. As shown in FIG. 5A, hair brush 200 includes a handle 214, a cone brush head 216, and bristles 230. In the embodiment shown in FIG. 5A, the cone brush head 200 is hollow and has a defined number of holes 217 that aide in the drying process. The difference between hair brush 10 and hair brush 200 is that the materials used in hair brush 10 contain metal and plastic while hair brush 200 is made of plastic material. Also, in hair brush 10 the bristles 30 protrude through the air vent holes 17 of the cone brush head while the bristles 230 of hair brush 200 are attached to the surface and radiate outward of hair brush 200.

Figure 7A:
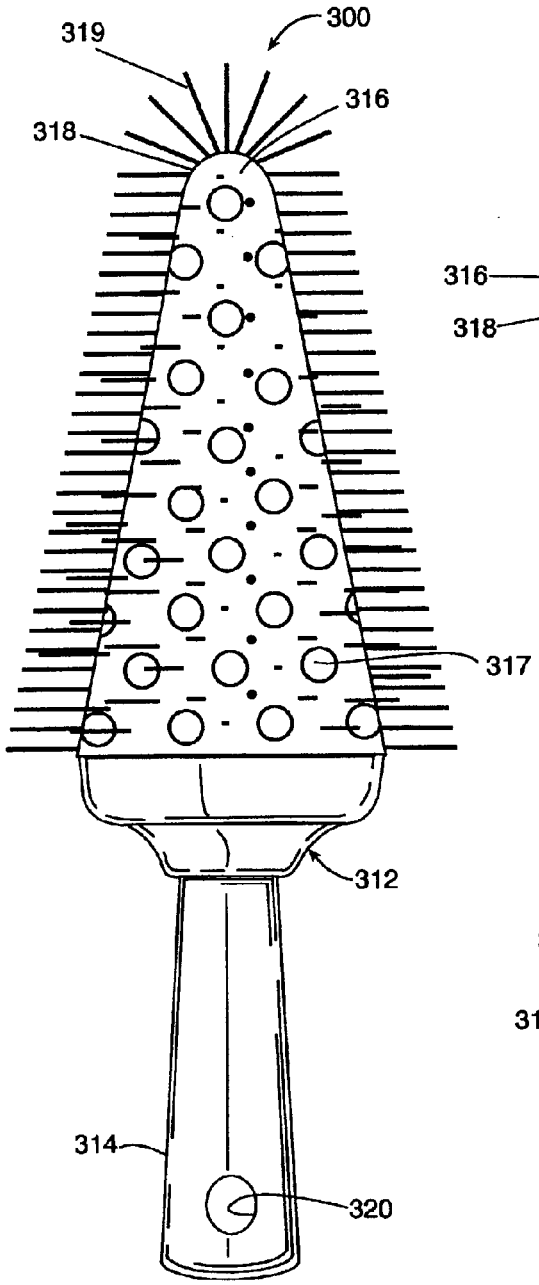
FIGS. 7A–7C and 8A illustrate another alternate embodiment of the cone brush head 300 of the present invention.
Figure 7B:
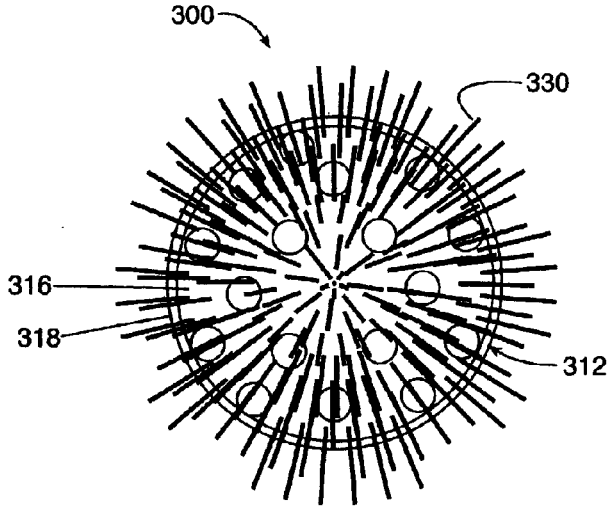
Figure 7C:
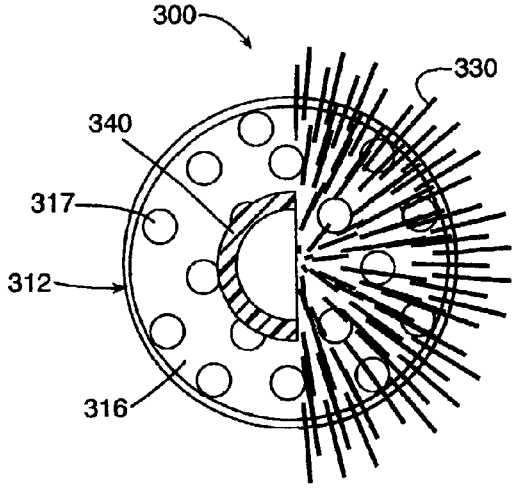
Figure 8A:
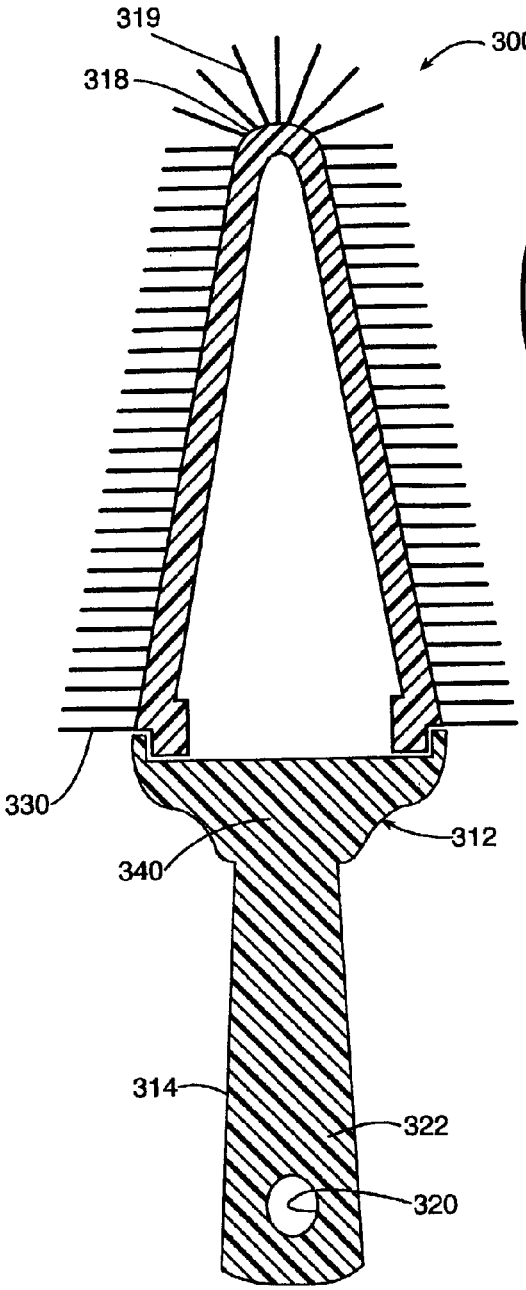
Figure 8B:
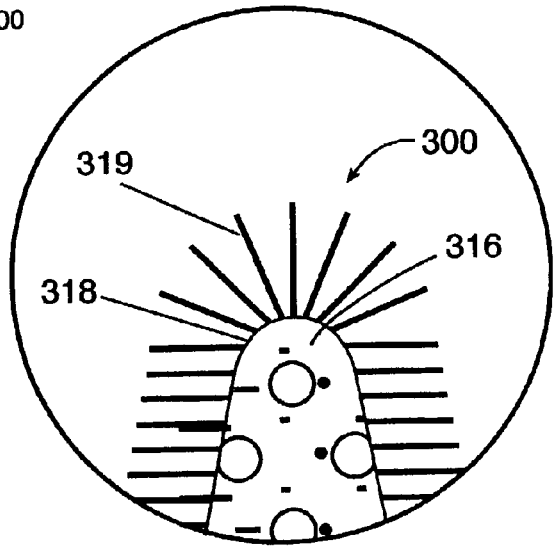
FIG. 8B illustrate a vertex top end view embodiment of the cone brush head 300 of the present invention.

FIGS. 7A–8 illustrate still another alternate embodiment of the cone brush head 300 of the present invention. FIG. 7A illustrate a frontal view of the hair brush 300. FIG. 7B illustrate a top end view of the brush head 300. FIG. 7C illustrate an additional top end view with a small exploded view of hair brush 300. FIG. 8A illustrate an exploded frontal view of hair brush 300. As shown in FIG. 7A, hair brush 300 includes a handle 314, a cone brush head 316, and bristles 330. In the embodiment shown in FIG. 7A, the cone brush head 300 is hollow and has a defined number of holes 317 that aide in the drying process. In the embodiment shown in FIG. 8B, one difference between hair brush 200 and hair brush 300 is the root lifting tip 319 which is a continuation of bristles 330 located at the vertex top end of hair brush 300.

Due to the unique shape of the cone brush head, different portions of hair are wrapped around a single area of the diameter and the resulting curls will vary, depending upon the diameter portion of the cone brush head onto which each part of hair is wound. For example, various curl sizes can be achieved by the use of this one present invention by simply wrapping the hair around a smaller or larger diameter of the cone brush head. The hair can start out having a small diameter, then progress to a larger diameter, then again to a larger diameter. Thus, the use of the cone brush head provides the advantage of producing a helical curl with a continuum of differing diameters. Also, the cone brush head provides an unexpected advantage of a root lifter due to the small size diameter located at the vertex of the brush head. Root lifting can be achieved by selecting a portion of damp hair at the roots touching the scalp and partially drying the hair before wrapping it around the diameter of choice, then blow drying the hair for rapid curl results.

Conventional hot-air brushes are unable to provide the advantages and/or hair styling shapes and techniques obtained by using the cone brush head of the present invention. This is the result of the hair being wrapped around a cylindrical curler having a single diameter. Also there would be a need for multiple hairbrushes to produce similar curl diameters that this one present invention provides. Additionally, the unique shape of the cone brush head allows the hairbrush of the present invention to be used in a manner which can not be duplicated using conventional, cylindrical hairbrushes. For example, the cone brush head can provide small to large size curls with a single lock of hair that achieves a unique spiral curl technique in one setting.

While several preferred embodiments of this invention have been described in the specification and illustrated in the drawings with reference to a preferred embodiment, it is to be understood that this invention is not limited to these precise embodiments and that it will be understood by those skilled in the art that various changes may be made and equivalents may be substituted for elements thereof without departing from the scope or spirit of the invention as defined in the appended claims.

What is claimed is:

1. A hair brush comprising:

an elongated handle including a main body portion having an annular groove therein;

an elongate twisted wire core having a first end extending from an end of said handle and a second free end, said twisted wire core including a plurality of bristles extending therefrom, the free end of the bristles defining a conical shape;

a hollow head portion having a first end engaged with the annular groove of the main body portion and a second end adjacent the second end of the wire core, said head portion having a conical shape and including a plurality of holes formed therein, said bristles extending through the holes in the head portion and the holes further permitting air from a dryer to pass through the head portion and thus aiding in drying and shaping of hair, each of the bristles having a portion extending beyond an outer surface of the head portion which extending bristle portion has substantially the same length; and a retainer cap fixed to the second end of the wire core, said retainer cap having a rounded end portion and an annular step portion, the second end of the head portion engaging the annular step portion and a side wall portion of the retainer cap being substantially flush with the outer surface of the head portion.

2. A hair brush comprising:

an elongated handle including a main body portion having an annular rim defining a circular recessed portion;

a one-piece hollow head portion, said head portion having a conical shape including a first end engaged with the recessed portion of the body portion and a second generally rounded end, said first end of the head portion including a portion extending therefrom which defines a notched region, the extending portion extending into the recessed portion of the body portion and the notched region receiving the annular rim thereof, the head portion further including a plurality of holes therein which permit air from a dryer to pass through the head portion and thus aiding in drying and shaping of hair; and a plurality of bristles having base ends fixed to and extending from an outer surface of the head portion, each of the bristles have substantially the same length such that free ends of the bristles define the same conical shape as the head portion.

* * * * *